US005086848A

United States Patent [19]

Hudak

[11] Patent Number: 5,086,848

[45] Date of Patent: Feb. 11, 1992

[54] REVERSIBLE IMPACT HOLE DRILLER AND METHOD OF REVERSING

[76] Inventor: Donald M. Hudak, 5454 Coronada Dr., Mentor, Ohio 44060

[21] Appl. No.: 600,431

[22] Filed: Oct. 19, 1990

[51] Int. Cl.[5] ..... E21B 11/02

[52] U.S. Cl. ..... 173/1; 173/91; 173/135

[58] Field of Search ..... 173/91, 135, 137, 139, 173/128; 175/19; 91/12, 234

[56] References Cited

U.S. PATENT DOCUMENTS 3,137,483 6/1964 Zinkiewicz .
3,407,884 10/1968 Zygmont et al. .
3,616,865 11/1971 Sudnishnikov et al. .
3,651,874 3/1972 Sudnishnikov et al. .
3,727,701 4/1973 Sudnishnikov et al. .
3,756,328 9/1973 Sudnishnikov et al. .
3,763,939 10/1973 Sudnishnikov et al. .
3,891,036 6/1975 Schmidt .
3,920,086 11/1975 Goppen et al. ..... 173/139
3,995,702 12/1976 Klimashko et al. ..... 173/91
4,078,619 3/1978 Sudnishnikov et al. ..... 173/91
4,114,700 9/1978 Tkach et al. .
4,132,277 1/1979 Tupitsyn et al. .
4,250,972 2/1981 Schmidt .
4,284,147 8/1981 Jenne .
4,295,533 10/1981 Schmidt .
4,609,052 9/1986 Lewin .
4,618,007 10/1986 Kayes .
4,662,457 5/1987 Bouplon .

*Primary Examiner*—Frank T. Yost
*Assistant Examiner*—Scott A. Smith
*Attorney, Agent, or Firm*—Watts, Hoffmann, Fisher & Heinke Co.

[57] ABSTRACT

An improved reversing mechanism in an impact hole drilling tool having a tubular body with a forward ground piercing end and a rearward pneumatic supply end. The reversing mechanism includes a slot coacting with a key to guide an interior tool valve in relative longitudinal movement when shifted from one of its directional motion positions to the other. The mechanism also has elements for biasing the valve mechanism longitudinally toward its forward motion position and rotationally toward at least one relative mechanism orientation wherein the key and slot are not aligned. Tool direction reversal, from forward to reverse direction, occurs without interruption of the pneumatic supply by applying rotational and pneumatic longitudinal force against the biasing elements, returning the tool to its forward direction position upon interruption of the pneumatic force.

9 Claims, 3 Drawing Sheets 14
42
26
44
2
2
46
11
38
48
24
36
40
10
34
32
22
30
16
28
20
12
19
18

26
46
4
4
24
50
48
40
28
18
19
20
12

54
56
46

54
56

56
38
44

REVERSIBLE IMPACT HOLE DRILLER AND METHOD OF REVERSING

FIELD OF THE INVENTION

The present invention relates generally to a pneumatic reversible hole drilling tool having a reciprocating striker and in particular to an improved tool reversal mechanism allowing directional reversal without interruption of the pneumatic source.

BACKGROUND ART

Pneumatically operated tools utilizing interior reciprocating striker mechanisms for punching holes through the ground are well known. In use such a tool is connected to a pneumatic pressure source and aimed in the desired direction. The pneumatic pressure causes a striker within the tool casing to reciprocate, thereby effectuating the self propulsion of the tool through the soil.

These tools are often employed in constructing pathways for installing utility piping an electrical cable in locations in which trenching would be difficult, such as underneath roadways. Frequently, the forward motion of the tool will be halted by obstructions in the soil. When such an obstruction is encountered it is desireable to reverse the direction of the tool so that the obstruction may be removed, or so that the tool may be diverted around the obstruction.

Numerous mechanisms and methods have been developed for selectively controlling the directional movement of these tools. Generally, tool directional reversal has been accomplished with rotatable valve members. Unfortunately, each such mechanism has exhibited certain undesirable characteristics in accomplishing tool reversal. Each such mechanism communicates the pneumatic pressure between an internal valve and the reciprocating striker at two different locations, one forward for forward tool direction, the other location being rearward for reversed tool direction. Tool propulsion is caused by the striker impacting with either the forward or rear end of the interior tool casing.

A number of prior art mechanisms for tool direction reversal propose to accomplish reversal with threads which shift the valve member and pneumatic supply conduit rearward. Such mechanisms operate by rotating the conduit and valve, a significant number of rotations. Use of such mechanisms in practice is extremely slow and difficult. Additionally, the difficulty of tool direction reversal is frequently exacerbated due to bends in the pneumatic supply conduit which inhibits conduit rotation and by partial cave-ins of the hole being formed. Unintended relative rotation of these screw type reversal mechanisms may also cause a loss of striker impact force during use.

Other prior reversal proposals effect tool direction reversal by rotating the valve member, supported by a valve guide. However, such mechanisms seem to be prone to inadvertent reversal. Accordingly, there have been proposals for improved reversing mechanisms which have sought to remedy inadvertent reversal by utilizing locking means to secure the valve assembly in either forward or reverse motion position, thereby preventing unwanted valve member rotation. One such mechanism utilizes a interengaging pin and slot arrangement. Directional reversal is accomplished by interrupting the pneumatic pressure supply and rotating the valve member and pins, out of their lock position before reconnecting the pneumatic pressure. Upon resupply, the pneumatic pressure longitudinally directs the valve assembly rearward, engaging the pins in rear pin holes, thereby locking the valve in reverse motion position. Tool operation then proceeds. Unfortunately, pneumatic pressure interruption consumes time and complicates tool operation.

SUMMARY OF THE INVENTION

An underground impact hole drilling tool made in accordance with this invention has an improved reversing mechanism which allows tool direction reversal without interruption of the pneumatic pressure supply. The improved reversing mechanism is operable with minor rotation of the pneumatic supply conduit without interrupting the pneumatic pressure supply. The tool provides simpler and more reliable reversal while conserving operational time and manpower.

The tool of this invention is to provide a spring biased key and channel locking mechanism which prevents inadvertent tool reversal from both forward and rearward motion positions while allowing tool direction reversal without interruption of the pneumatic source. An additional feature of the tool of this invention is automatic positioning of the tool to its forward tool advancing range upon interruption of the pneumatic source, thereby allowing a tool operator to alternate the tool between forward and reverse direction when obstructions are encountered, both reliably and with a minimum of effort. Moreover, the construction also assures that the tool will always be in its forward range when use is initiated. Thus, the operator cannot inadvertantly operate the tool in its reverse mode when a forward mode is desired. Additional benefits of the invention will become apparent and a fuller understanding obtained by reading the following detailed description made in connection with the accompanying drawings.

BEST MODE FOR PRACTICING THE INVENTION

Figures 1, 2, 3, 4, 4A:
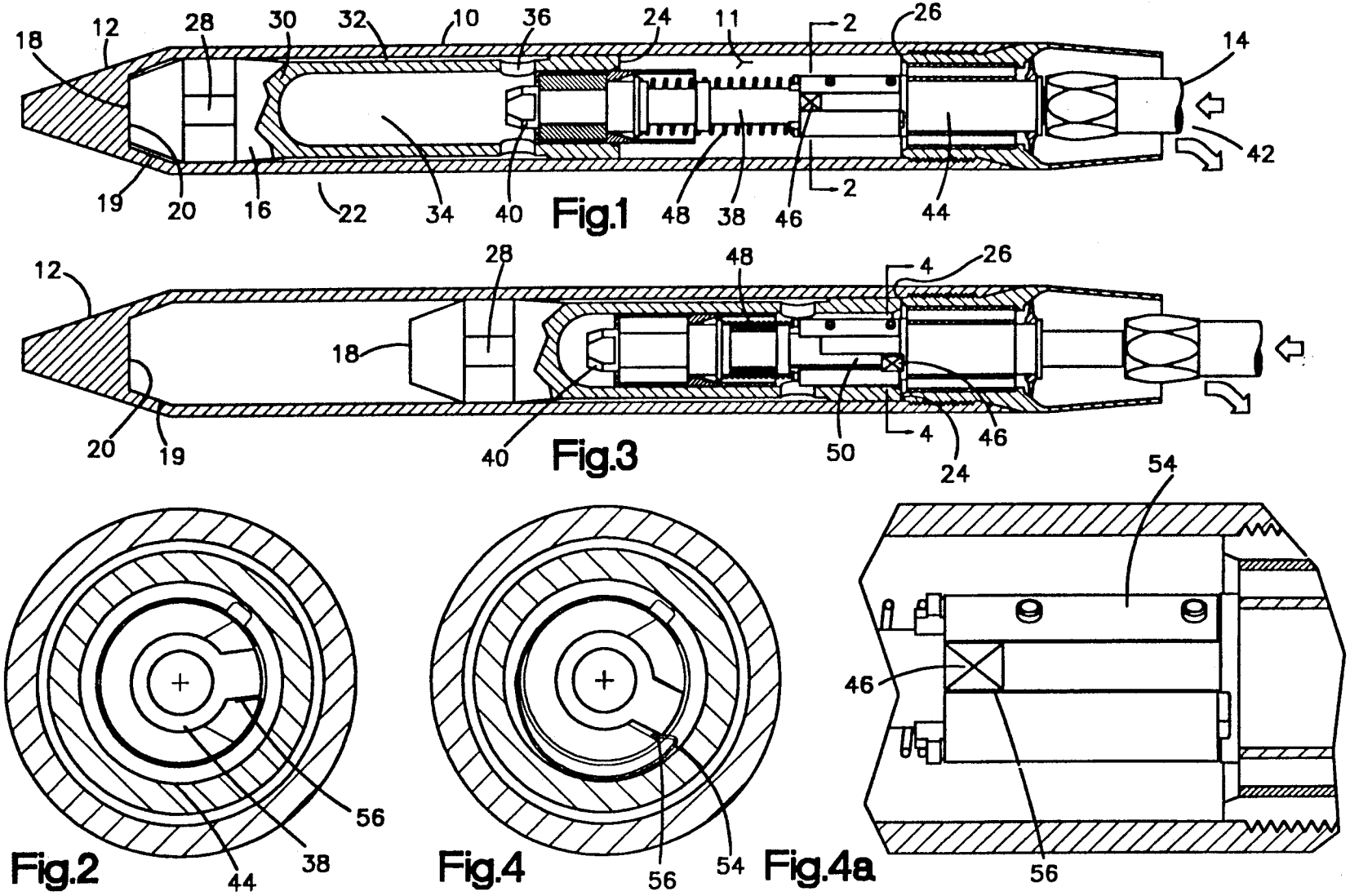
FIG. 1 is a longitudinal cross section of an impact hole drilling tool in forward motion position.
FIG. 2 is a sectional view on an enlarged scale of the reversing mechanism shown in FIG. 1 as seen from the plane indicated by the line 2—2 in FIG. 1.
FIG. 3 is a sectional view of the impact hole drilling tool in its reverse motion position.
FIG. 4 is a sectional view on the scale of FIG. 2 of the impact hole drilling tool as seen from the plane indicated by the line 4—4 in FIG. 3.
FIG. 4*a* is an exploded sectional view of the reversing mechanism shown in Figure 1.
Figure 5:
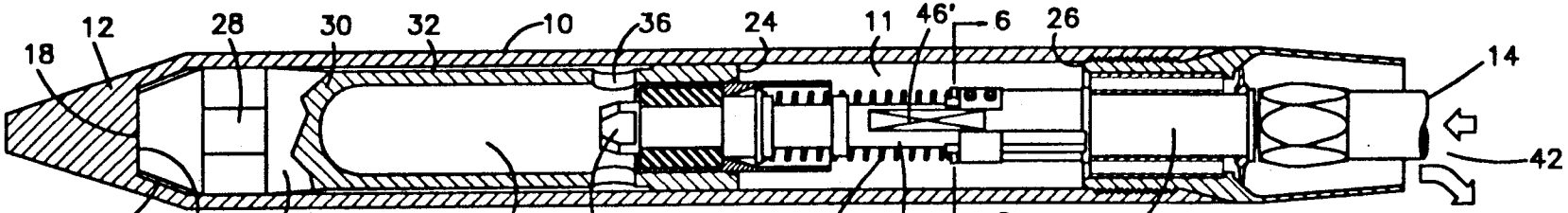
FIG. 5 is a longitudinal cross section of a second embodiment, shown in its forward motion position.
Figure 7:
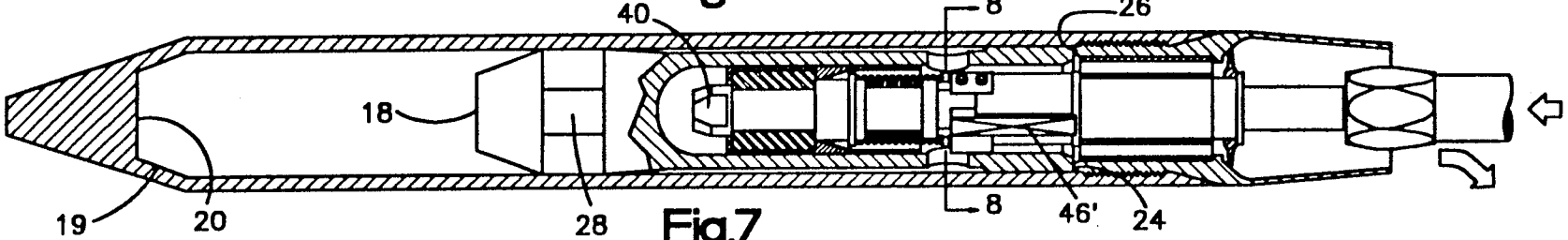
FIG. 7 is a sectional view of the embodiment shown in FIG. 5 in its reverse motion position.

Referring now to FIGS. 1 through 4*a*, the impact hole drilling tool of this invention includes an elongate, tubular body (10) which extends from a forward piercing end (12) to a rearward pneumatic supply end (14). The tool includes a reciprocating striker (16) inside the tubular body. The striker (16) has a front impact surface (18). In use, the surface (18) impacts on a forward tool advancing surface (20) of the body (10) when the tool is in a forward tool advancing range (22). The striker (16) has and a rear impact surface (24) for impact on a rearward tool retraction surface (26) when the striker is in a rearward tool retraction range (27).

The exterior of the striker near the front is fitted to the interior surface (11) of the tubular body to guide the reciprocating motion of the striker (16). The striker (16) has machined depressed surfaces (28) to permit the supply of pneumatic pressure to the front impact cavity (19).

The striker body (30) has a reduced central diameter portion. A cavity (32) is defined by the reduced diameter portion and the interior surface (11).

The striker (16) has an interior cylindrical cavity (34). The striker (16) also has exhaust ports (36) which provide communication between the cavities (32), (34) when the striker is in the position shown in FIG. 1.

The tubular pneumatic valve (37) has a forward valve end portion (40) fitted inside the striker. The end portion (40) defines one end of the interior cylindrical cavity (34). The forward valve end portion (40) and the striker (16) also function to periodically close the exhaust ports (36) as the striker (16) slidably reciprocates within the tool body (10). The coaction of the striker (16) and the forward valve end portion (40) coact in a piston and cylinder relationship.

The striker coacts with a tubular pneumatic valve (37) for confining pneumatic pressure in the cavity (34) for driving the striker forward. As the striker moves forward, pressure is delivered through the ports (36) and into the front striker impact cavity (19) and striker cavity (32) to force the striker (16) into rearward motion.

The pneumatic valve (37) has a tubular central stem (38) extending from an exterior pneumatic source coupling (42) to the forward valve end portion (40). The valve (37) central stem (38) includes a key mechanism (46). The valve central stem (38) is also surrounded by a coil spring (48) to urge the stem (38) in a longitudinally forward direction. The stem (38) is movably supported within the tool body (10) by a concentrically disposed valve guide mechanism (44) which is secured to the tool body (10).

The valve guide mechanism (44) includes a slot (50). The slot (50) is coactable with a key mechanism (46), when the two are aligned, to guide the valve stem (38) in relative longitudinal movement. Upon the alignment of the key and slot and the application of pneumatic force, the relative movement is rearward to position the valve (37) and hence the striker (16) in rearward tool retraction range (27) as shown in FIG. 3.

The valve guide mechanism (44) also includes a rotation or half spring (54) concentrically affixed, as shown in FIG. 2, to an exterior forward section (55) of the guide (44). The rotation spring (54) has a lip (56) which extends into and along the slot (50). The lip (56) is in coactable relationship with the slot (50) and the key (46). The rotation spring lip (56) coacts against said key (46) and central stem (38) in forward tool advancing range (22), positioning said key (46) and stem (38) so that the key (46) and slot (50) are not longitudinally aligned as in FIG. 1. The key (46) acts against a forward end of the forward section (55) of the valve guide mechanism (44) to maintain the valve (37) in its forward tool advancing range.

The tool may be shifted from the forward tool advancing range (22) to the rearward tool retraction range (27), without interrupting the pneumatic source. To accomplish this shifting, an operator rotates the stem (38), (42) and key (46), against the rotation spring (54) and the lip (56), shown in FIG. 4. The rotation longitudinally aligns the key (46) and slot (50). The pneumatic pressure then compresses the relatively weak coil spring (48), slidably moving the key (46) along the slot (50) into rearward tool retraction range (27) as shown in FIG. 2.

Upon interruption of the pneumatic source, the coil spring (48) slidably returns the stem (38) and key (46) along the slot (50) into forward tool advancing range (22). Upon the return of the stem (38) and key (46) into forward tool advancing range (22), the rotation spring (54) and the lip (56) coact against the key (46) to rotate the stem (38), locking the tool in forward tool advancing range (22) against the forward section 55 of the valve guide mechanism (44).

Referring now to a second embodiment of the invention, shown in FIGS. 5 through 8*a*, many of the components are identical and will be so identified without detailed description, while other elements will be identified with the corresponding numeral primed. Tool operation occurs identically to the operation described in relation to the first embodiment.

A reciprocating striker (16) having a front impact surface (18) is positioned about the pneumatic valve member (37) within the tubular elongate body (10) of the impact drilling tool. The pneumatic valve member (37) extends from a pneumatic source coupling (42) to a forward valve end (40). The forward valve end (40) coacts with the striker interior cylindrical cavity (34) to create a piston and cylinder relationship. As the pneumatic source forces air into the striker interior cylindrical cavity (34), the striker (1 6) slidably moves forwardly within the elongate tubular body (10) of the tool, causing a forward impact between the striker front impact surface (18) and the forward tool advancing surface (20). As forward impact occurs, the exhaust ports (36) and forward valve end (40) align to communicate the cavity (34) with the exhaust body cavity (32). The air under pressure flows from the exhaust body cavity (32) through the depressed surfaces (28) into the front striker impact cavity (19) forcing the striker to move towards rearward tool retraction range. As in the first embodiment, the constant application of pneumatic pressure causes striker (16) reciprocation within the tool body (10).

In this second embodiment, like the first, the pneumatic valve member (37) has the relatively weak coil spring (48) coacting against a valve guide mechanism (44) for biasing the valve member (37) longitudinally toward its forward tool advancing range (22). The valve member stem (38) of this second embodiment carries an elongate key mechanism (46').

The valve guide (44) is concentrically disposed about the pneumatic valve member stem (38) having a slot (50) to slidably receive the elongate key (46'). The valve member allows both rotational and longitudinal movement of the valve mechanism to facilitate the alignment of the elongate key (46') and lo the slot (50). The valve guide mechanism (44) also includes a rotation spring (54') that is short in an axial direction as contrasted with rotation spring (54). The rotation spring (54') is concentrically affixed to the forward section (45) (44) and about the exterior of the valve stem (38).

The rotation spring (54') includes a lip (56') extending into and along the slot (50) in coactable relationship with the slot (50) and the elongate key (46'). The rotation spring (54') and lip (56') coact against the elongate key (46') and central stem (38) in the forward tool advancing range (22), retaining the u elongate key (46') and stem (38) so that the elongate key (46') and slot (50) are not longitudinally aligned.

Figure 8A:
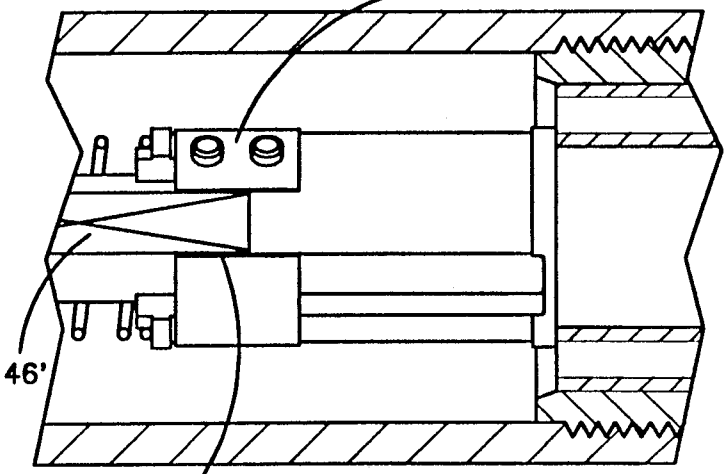
FIG. 8*a* is an exploded sectional view of the reversing mechanism shown in FIG. 5.
Figure 8:
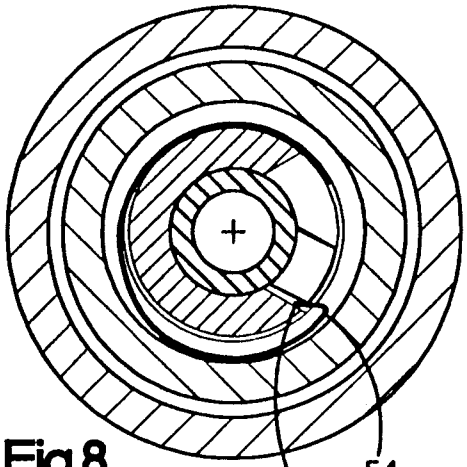
FIG. 8 is a sectional view on the scale of FIG. 2, of the second embodiment as seen from the plane indicated by line 8—8 in FIG. 7.
Figure 6:
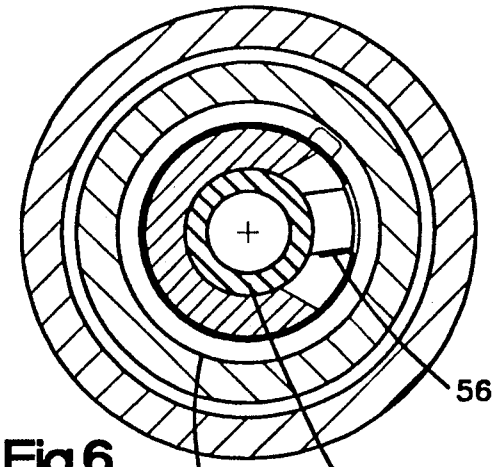
FIG. 6 is a sectional view on the scale of FIG. 2, of the embodiment described in FIG. 5, as seen from the plane indicated by the line 6—6 in FIG. 5.
Figure 9:
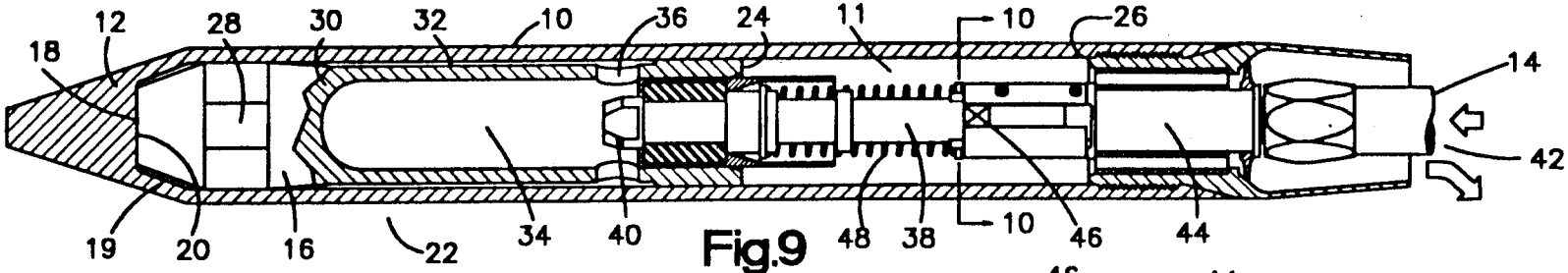
FIG. 9 is a sectional view of a third embodiment of the present invention, in forward motion position.

The tool may be shifted from forward tool advancing range (22) to rearward tool retraction range (27), without interrupting the pneumatic source, by rotating the stem (38), and elongate key (46') against the lip (56') as shown in FIG. 8, to longitudinally align the key (46') and slot (50). Once aligned the pneumatic pressure compresses the coil spring (48) and slidably moves the elongate key (46') and the valve member (38) along the slot (50) into its rearward tool retraction range (27).

Upon interruption of the pneumatic source, the coil spring (48) slidably returns the valve member stem (38) and elongate key (46') along the slot (50) into forward tool advancing range (22). Upon the return of the valve member (37) into forward tool advancing range (22), the rotation spring (54') coacts against the elongate key (46') and pneumatic valve member (38), rotating the valve member (38) to lock the member (38) in the forward tool advancing range (22)

A third embodiment of the invention includes a valve locking mechanism in the rearward tool retraction range (27) and is shown in FIGS. 9 through 12. This third embodiment is the same as the first other than for the rearward range lock.

Figure 11:
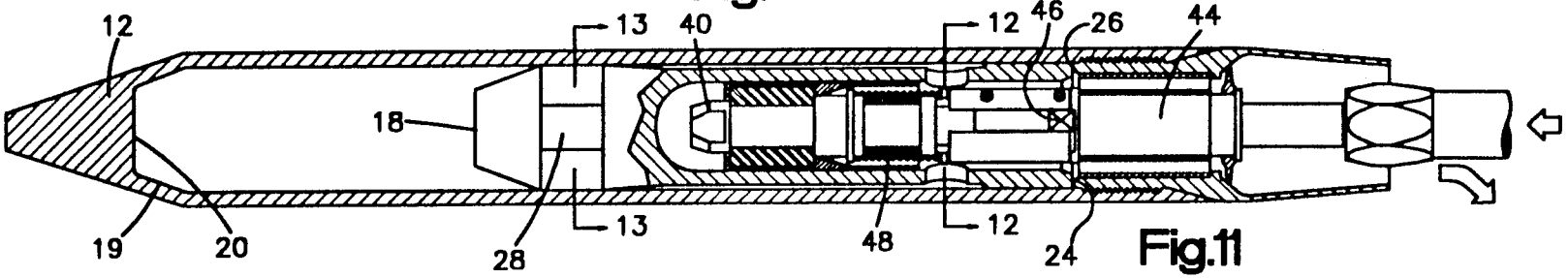
FIG. 11 is a sectional view of the third embodiment, in its reverse motion position.
Figure 13:
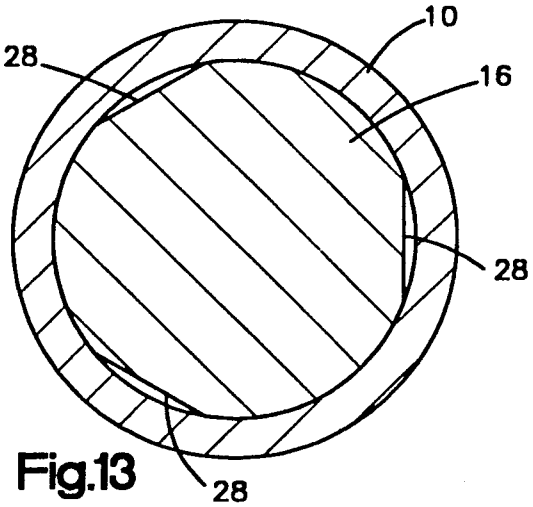
FIG. 13 is a sectional view, on the scale of FIG. 2, of the striker and annular air passages, as seen from the plane indicated by line 13—13 in FIG. 11.
Figure 12:
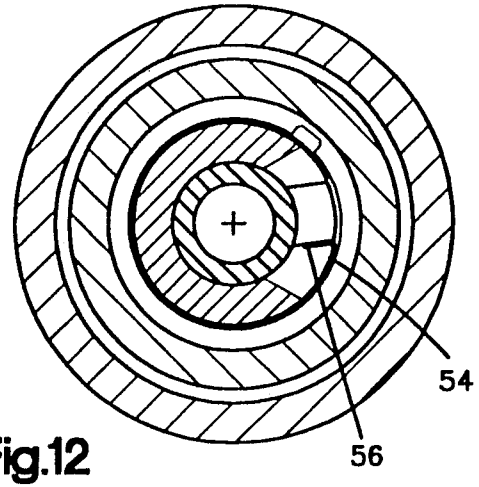
FIG. 12 is a sectional view, on the scale of FIG. 2, of the third embodiment, as seen from the plane indicated by line 12—12 in FIG. 11.
Figure 10:
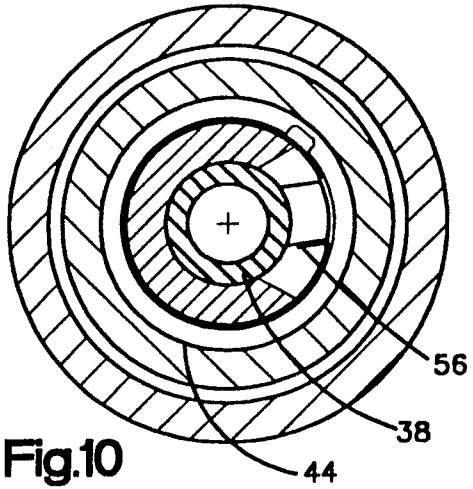
FIG. 10 is a sectional view, on the scale of FIG. 2, of the third embodiment described in FIG. 9, as seen from the plane indicated by line 10—10 in FIG. 9.

In the third embodiment, like the first, the tool may be automatically shifted from forward tool advancing range (22) to rearward tool retraction range (27), without interrupting the pneumatic source. This is accomplished by rotating the stem (38) and key (46) to longitudinally align the key (46) and slot (50), allowing the pneumatic source to compress the coil spring (48) and slidably move the key (46) and pneumatic valve member (37) along the slot (50) into rearward tool retraction range (27). Once the valve member (38) moves into rearward tool retraction range, the rotation spring (54) coacts against the key (46) and valve member (38), rotating the valve member into rearward lock position (56) as shown in FIG. 11. In this rearward lock position the key (46) is disposed in a rearward lock recess (57) which is formed in the forward section (55). The recess communicates with the slot (50) at its rearward end.

Upon interruption of the pneumatic pressure, the rotation spring (54) retains the key (46) in the recess, thus locking the valve (37) in rearward tool retraction range (27). Rotation of the valve member (38) and key (46) against the spring bias (54), to align the key (46) with the slot (50) allows the coil spring (48) to return the valve (37) to forward tool advancing range (27). Upon the return of the valve (37) to forward tool advancing range (22), the rotation spring (54) coacts against the key (46), rotating the valve member (38) to lock the member (38) in forward tool advancing range (22).

Although the invention has been described with a certain degree of particularity, it should be understood that those skilled in the art can make Various changes to it without departing from the spirit or scope as hereinafter claimed. Moreover, the features of one embodiment may be incorporated in another, and the scope of the invention is not limited to the details of these embodiments but is of the full scope of the claims.

I Claim:

1. An impact hole drilling tool comprising:

a) an elongate, tubular body extending from a forward ground piercing end to a rearward pneumatic supply end;

b) a reciprocating striker within the body, the striker being selectively positioned in a forward tool advancing range and a rearward tool retraction range;

c) a tubular valve mechanism within the body, the valve mechanism being selectively positioned in a selected one of a forward motion producing position and a longitudinally spaced rearward motion producing position;

d) the valve mechanism and striker having ports and surfaces coactable to produce striker reciprocation on application of pneumatic pressure when the valve mechanism is in a selected one of its positions;

e) a valve guide mechanism secured to the body near the pneumatic supply end, the valve guide mechanism be concentrically disposed in coacting relatively moveable relationship with the valve mechanism;

f) one of the mechanisms including a slot and the other mechanism including a key coactable with the slot to guide the mechanisms in relative longitudinal movement when the valve mechanism is shifted from one of its positions to the other;

g) spring means interposed between the mechanisms for biasing the valve mechanism longitudinally toward its forward motion position and rotationally toward at least one relative mechanism orientation wherein the key and slot are not aligned longitudinally; and h) said valve mechanism being moveable from its forward to its rearward motion position upon application of rotational and pneumatically applied longitudinal force against the action of the biasing means and returnable to its forward position in response to force supplied by the biasing means after pneumatic force application has been interrupted.

2. The tool of claim 1 wherein said spring means is rigidly attached to said valve guide mechanism near said slot biasing the said valve mechanism toward its forward motion position by interrupting the longitudinal coaction of said key and said slot mechanism.

3. The tool of claim 1 wherein said key mechanism and valve mechanism coact against said spring bias prohibiting relative longitudinal coaction with said slot in forward motion position and rotationally allowing motion position reversal along said slot, said spring bias and pneumatic force thereby restricting longitudinal coaction with said slot in reverse motion position.

4. The tool of claim 1 wherein said slot and key mechanism coact with said spring bias, comprising a reverse motion position lock of said valve mechanism, said spring bias restricting the longitudinal motion of said key within said slot.

5. The tool of claim I whereby said valve guide mechanism, being concentrically disposed in coacting relatively moveable relationship with said valve mechanism, having an elongated slot of predetermined length selectively positioned in relationship with said spring bias and said key.

6. The tool of claim 1 whereby one of said mechanisms comprises an elongate key of predetermined length coactable with said slot to guide the longitudinal movement of the mechanisms when said tool is reversed from its forward motion position or its reward motion position.

7. The tool of claim 1 wherein the spring means for biasing the valve mechanism toward at least one relative mechanism orientation extends into said slot to coact with said valve mechanism over the width of said slot.

8. A method of reversing the operational direction of a pneumatic impact hole drilling tool having a longitudinally and rotationally spring biased, tubular, valve mechanism having a keyed portion, said mechanism coacting with a valve guide, said guide having a channel portion to receive said keyed portion of said valve mechanism, the method comprising:

a. operatively connecting a pneumatic supply to said valve mechanism;

b applying a counter rotational biasing force to said valve mechanism to align the keyed portion of said mechanism with said channel portion from an otherwise non-aligned position thereby allowing said pneumatic supply to overcome said longitudinal spring bias to shift said mechanism from a forward tool advancing range to a rearward tool retraction range; and, c. interrupting said pneumatic supply to allow said longitudinal spring bias force to shift said valve into said forward tool advancing range.

9. The method of claim 8 wherein step c. further comprises applying a counter rotational force to said valve stem to align the keyed portion of said valve stem with said channel portion of said valve guide thereby allowing the longitudinal spring bias to move said valve stem into a forward tool advancing range.

* * * * *